United States Patent [19]

Harwood

[11] 4,438,788

[45] Mar. 27, 1984

[54] PAPERMAKERS BELT FORMED FROM WARP YARNS OF NON-CIRCULAR CROSS SECTION

[75] Inventor: William J. Harwood, Waycross, Ga.

[73] Assignee: Scapa Inc., Waycross, Ga.

[21] Appl. No.: 258,047

[22] Filed: Apr. 28, 1981

Related U.S. Application Data

[63] Continuation-in-part of Ser. No. 192,216, Sep. 30, 1980.

[51] Int. Cl.[3] ..... D03D 15/00; D21F 7/10; D21F 1/12

[52] U.S. Cl. ..... 139/383 A; 139/408; 139/425 A; 162/DIG. 1; 245/10

[58] Field of Search ..... 139/383 A, 383 AA, 425, 139/408–413, 425 A; 162/DIG. 1, 348, 349, 358; 245/8, 10; 34/95, 116, 123; 24/31 H, 33 C

[56] References Cited

U.S. PATENT DOCUMENTS

| | | | |
|---|---|---|---|
| 3,957,090 | 5/1976 | Muhlen et al. | 139/383 A |
| 4,026,331 | 5/1977 | Lees et al. | 139/383 A |
| 4,071,050 | 1/1978 | Codorniu | 139/425 A |
| 4,086,941 | 5/1978 | Thompson | 139/383 A |
| 4,142,557 | 3/1979 | Kositzke | 139/425 A |
| 4,182,381 | 1/1980 | Gisbourne | 139/383 A |
| 4,224,372 | 9/1980 | Romanski | 139/383 A |
| 4,244,084 | 1/1981 | Gisbourne | 139/383 A |
| 4,274,448 | 6/1981 | Westhead | 139/383 A |
| 4,290,209 | 9/1981 | Buchanan et al. | 139/383 A |

FOREIGN PATENT DOCUMENTS

| | | | |
|---|---|---|---|
| 2120967 | 11/1971 | Fed. Rep. of Germany | 162/DIG. 1 |
| 1220531 | 1/1971 | United Kingdom | 139/383 A |

*Primary Examiner*—James Kee Chi

*Attorney, Agent, or Firm*—Fleit, Jacobson, Cohn & Price

[57] ABSTRACT

A papermakers fabric having surface floats on both the paper surface and the non-paper contacting surface for improved sheet contact area and improved abrasion resistance. The fabric also includes a plurality of stuffer pick receiving sheds defined by warp yarns of non-circular cross section used to weave the fabric. In a preferred embodiment, the warp yarns are of generally rectangular cross section with rounded corners. Each of these sheds may receive a stuffer pick, the construction of which will be determined by the permeability required in the finished fabric, while the warp and weft yarns used to define the fabric remain unchanged. The warp ends of the fabric terminate in a pin seam made up of a number of enlarged seam loops which are created when a select number of the warp yarns of non-circular cross section are symmetrically rewoven into the fabric.

13 Claims, 9 Drawing Figures

| 16 | 15 | 14 | 13 | 12 | 11 | 16 | 15 | 14 | 13 | 12 | 11 | |
|---|---|---|---|---|---|---|---|---|---|---|---|---|
| | | X | | | X | | | X | | | X | 21 |
| X | | X | X | | X | X | | X | X | | X | 22 |
| X | | X | | X | X | X | | X | | X | X | 23 |
| X | | X | | | X | X | | X | | | X | 24 |
| X | | X | | X | | X | | X | | X | | 25 |
| X | | X | | | | X | | X | | | | 26 |
| X | | | | X | | X | | | | X | | 27 |
| X | X | X | | X | | X | X | X | | X | | 28 |
| X | X | | X | X | | X | X | | X | X | | 29 |
| X | X | | | X | | X | X | | | X | | 30 |
| | X | | X | X | | | X | | X | X | | 31 |
| | X | | | X | | | X | | | X | | 32 |
| | X | | X | | | | X | | X | | | 33 |
| | X | | X | X | X | | X | | X | X | X | 34 |
| | X | X | X | | X | | X | X | X | | X | 35 |
| | X | | X | | X | | X | | X | | X | 36 |
| | | X | X | | X | | | X | X | | X | 37 |
| | | | X | | X | | | | X | | X | 38 |

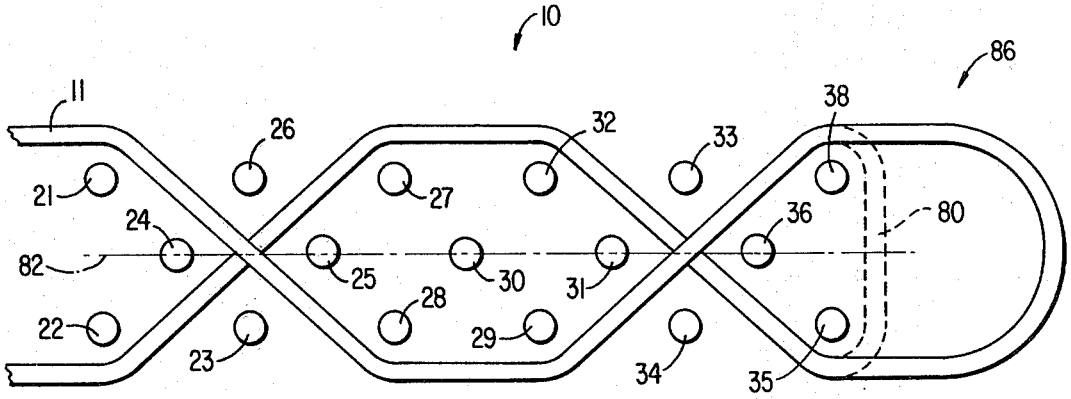
FIG. 3
FIG. 4
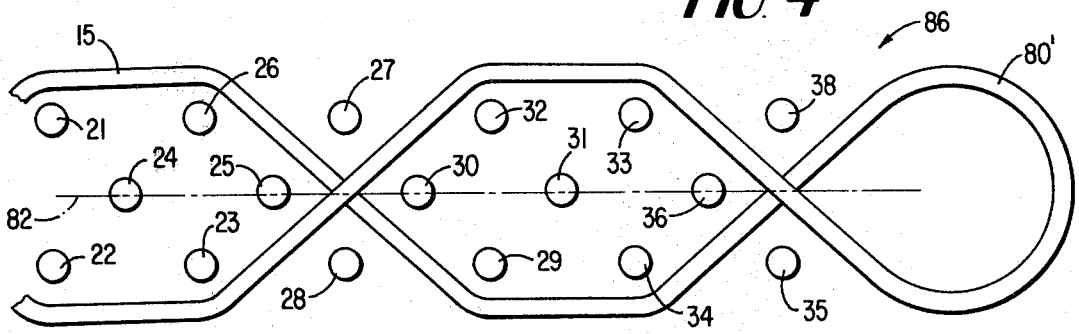
FIG. 5
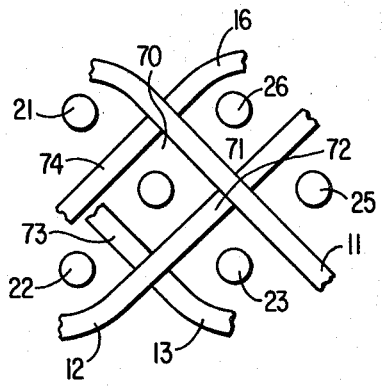
FIG. 6
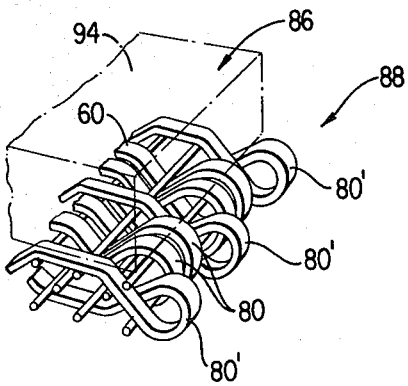
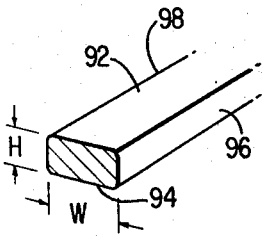
FIG. 7

| 16 | 15 | 14 | 13 | 12 | 11 | 16 | 15 | 14 | 13 | 12 | 11 | |
|---|---|---|---|---|---|---|---|---|---|---|---|---|
| X | | | X | | | X | | | X | | | 21 |
| X | | | X | X | X | X | | | X | X | X | 22 |
| X | | | X | X | | X | | | X | X | | 23 |
| | | | X | X | | | | | X | X | | 24 |
| X | X | | X | X | | X | X | | X | X | | 25 |
| | X | | X | X | | | X | | X | X | | 26 |
| | X | | | X | | | X | | | X | | 27 |
| | X | X | X | X | | | X | X | X | X | | 28 |
| | X | X | | X | | | X | X | | X | | 29 |
| | X | X | | | | | X | X | | | | 30 |
| | X | X | | X | X | | X | X | | X | X | 31 |
| | X | X | | | X | | X | X | | | X | 32 |
| | | X | | | X | | | X | | | X | 33 |
| X | X | X | | | X | X | X | X | | | X | 34 |
| X | | X | | | X | X | | X | | | X | 35 |
| X | | | | | X | X | | | | | X | 36 |
| X | | X | X | | X | X | | X | X | | X | 37 |
| X | | | X | | X | X | | | X | | X | 38 |

PAPERMAKERS BELT FORMED FROM WARP YARNS OF NON-CIRCULAR CROSS SECTION

This is a continuation-in-part of copending application Ser. No. 192,216, filed Sept. 30, 1980.

BACKGROUND OF THE INVENTION

1. Field of the Invention

The present invention relates to papermakers belts or fabrics, in general, and to a papermakers belt having smooth surfaces and an enlarged seam loop as defined by the inclusion of warp yarns of non-circular cross section, in particular.

2. Description of the Prior Art

In the dryer section of a papermaking machine, endless fabrics referred to in the industry as papermakers belts, dryer felts or dryer fabrics are employed to convey a paper web through the dryer section in order to remove moisture from the web. In the dryer section, the papermakers belt must carefully support and guide the web.

In use, a papermakers belt in the dryer section comes into contact with a number of heated cylinders. The paper web, being dried, is sandwiched between the dryer felt and the heated cylinders. The better the contact of the paper web to the heated cylinders, the better and more efficient the drying.

Within limits, increasing the tension of the dryer felt increases the contact between the paper web and heated cylinders. However, above an optimum tension, there is little improvement in contact between the dryer felt, paper web and heated cylinders. In fact, high fabric tensions have the marked disadvantage of likely causing distortion in the fabric, which leads to fabric narrowing and changes in permeability. It is important that the papermakers belt be of uniform construction throughout its structure and of proper tension when on the papermaking machine, so as to prevent undulations or cockling in the paper sheet being dried.

One type of prior art fabric commonly used in the dryer section of a papermaking machine is a duplex weave having two planes, each defined by a different plurality of cross-machine direction or weft yarns. A plurality of machine direction or warp yarns are interwoven with the weft yarns in accordance with a standard weave pattern to define knuckles or single floats on both the paper-contacting and non-paper-contacting surfaces of the fabric. When used in the dryer section of a papermaking machine, the warp ends of the duplex fabric are joined together by any conventional means such as through the formation of a pin seam or the use of various sewn on seams, such as, clipper, spiral, or multiloop seams.

Because the standard duplex weave has a knuckle structure on both the paper and non-paper side, ability of the fabric to hold the paper web in uniform intimate contact with the heated cylinders is limited. This is because the intimate contact of fabric to paper to cylinder occurs at the knuckle peaks. In addition, the valleys between the knuckle peaks permit the presence of air, which further reduces drying efficiency.

Should a pin seam be selected as the means for joining the ends of the fabric to form a continuous belt, the conventional duplex fabric produces a small seam loop which makes the hand sewing operation for joining the ends of the fabric together extremely tedious and time consuming, thus, increasing the costs of downtime on the paper machine.

In yet another common type of duplex dryer fabric there is provided a two-layered structure with separate weft yarns forming top and bottom layers. In this fabric, warp yarns define floats, which span at least two weft yarns, on the paper (or top) surface of the fabric and warp knuckles or single-floats on the non-paper (or bottom) surface of the fabric. Because of the structure of the smooth paper surface fabric, there are no free areas in which to insert stuffer picks. All of the areas defined by the warp yarns are filled with a cross-machine direction weft yarn. Therefore, the common smooth face duplex weaves do not permit changing permeability by use of a range of stuffer picks.

Thus, each time a different permeability characteristic is desired by a papermaker for a specific application, the fabric manufacturer must change the warp and weft yarns used to weave these styles of duplex fabrics. Such an undertaking by the manufacturer contributes to increasing the cost of the finished fabric. This is to be contrasted against the use of stuffer picks of various constructions which permit the manufacturer to leave the warp and weft yarns unchanged.

Further, should a pin seam be selected, the individual seam loops, formed by the warp yarns, have a tendency to move out of the plane of the fabric and thus cause peaks along the seam. These peaks (or loop knuckles) can be pressed into the paper sheet causing marking of the paper. At the same time, the proud loops are prone to be abraded by rolls in the paper machine run causing premature failure at the seam when the loops are worn through.

Yet another example of a way to control permeability in a dryer felt is the incorporation of warp yarns of rectangular cross section into a weave pattern that does not include provision for stuffer picks. In such a weave pattern, the warp yarns on the paper-receiving surface of the fabric typically float over a plurality of weft picks. The larger the float, i.e., the more picks the warp crosses before weaving back into the fabric, the less stable the fabric becomes. In this way, there is a trade off between permeability and fabric stability.

In the duplex fabrics discussed above, the non-paper side of the fabric comes into contact with numerous machine rolls between the heated cylinders and also on the return run. Unlike the paper side, there is no paper sheet sandwiched between the non-paper side of the fabric and these machine rolls, nor are the rolls driven. The non-paper side is therefore abraded by driving these free-rotating rolls (due to roll/fabric slippage). These rolls also tend to become rusted, and this is another source of abrasion. On the duplex fabrics, the abrasion takes place on the non-paper side knuckles and can thereby be fairly rapid.

There is thus a need for a papermakers belt which is capable of providing a smooth surface on the paper side so that it may find universal application for varying grades of paper, while at the same time having a smooth non-paper contacting surface to improve resistance to abrasion and guidability of the fabric. In addition, the fabric should incorporate the ability to use various types of stuffer picks so that the basic yarns used to form the fabric may remain unchanged. Finally, the seam loop formed in the fabric should remain in the plane of the fabric and thus eliminate undulations along the pin seam. The present invention is directed toward filling that need.

SUMMARY OF THE INVENTION

The present invention relates to a papermakers belt having warp floats spanning two or more adjacent weft yarns on both the paper surface and the non-paper contacting surface for improved sheet contact area and improved abrasion resistance. The warp yarns used in defining the warp floats may be circular or non-circular in cross section. In a preferred embodiment, the non-circular cross section takes the form of a rectangle with rounded corners, the long dimension of the rectangle lying parallel to the plane of the fabric. It is also contemplated that the non-circular yarn may have an elliptical as well as a "D" shaped cross section, to name a few.

The fabric also includes a plurality of stuffer pick receiving sheds defined by the warp yarns used to weave the fabric. Through the use of the rectangular warp yarns, the walls defining the various sheds tend to be smoother than when warp yarns of circular cross section are employed. Each of the sheds receives a stuffer pick, the construction of which is determined by the permeability required in the finished fabric, while the warp and weft yarns used to define the fabric remain unchanged. In a preferred embodiment, the warp ends of the fabric terminate in a pin seam made up of a number of enlarged seam loops which are created when a select number of warp yarns are symmetrically rewoven into the fabric. It is to be understood that other well known methods of joining the ends of the fabric are contemplated, and the use of a pin seam is provided as a desirable example.

It is thus a primary object of the present invention to provide an improved papermakers belt having smooth paper and non-paper surfaces.

It is another object of the present invention to provide a papermakers belt having a pin seam loop of enlarged construction to facilitate joining of the fabric ends to create a continuous belt.

It is a further object of the present invention to provide a papermakers belt in which the permeability of the fabric may be altered through the use or non use of stuffer picks of different constructions while the basic yarns used to define the fabric remain unchanged.

It is yet an object of the present invention to provide a papermakers belt in which the percentage sheet contact area, and the percentage guide roll contact area are improved resulting in improved drying efficiency and improved guiding.

It is still an object of the present invention to provide an improved papermakers belt in which abrasion resistance on the non-paper side of the fabric is improved.

It is yet another object of the present invention to provide a papermakers belt having a pin seam which is much quicker and easier to seam than normal.

It is yet a further object of the present invention to provide a papermakers belt having a pin seam which is between the surface planes of the fabric, thus being non-marking and protected from wear and abrasion.

It is still a further object of the present invention to provide a papermakers belt in which permeability and contact area may be altered through the use of warp yarns of non-circular cross section, for example, yarns of rectangular cross section.

These and other objects of the present invention will become more apparent when viewed in conjunction with the drawings and detailed description which follow.

BRIEF DESCRIPTION OF THE DRAWINGS

FIG. 3 is a section through the weft of the fabric of FIG. 1 with all of the warp yarns, except one, being removed to show formation of a binder loop.

FIG. 4 is a section through the weft of the fabric of FIG. 1 with all of the warp yarns, except one, being removed to show formation of a seam loop.

FIG. 5 is an isolated view of a portion of the fabric of FIG. 1 to illustrate formation of a stuffer pick receiving shed.

FIG. 6 is a top perspective view of the warp ends of the fabric of FIG. 1 to illustrate formation of the warp end pin seams.

FIG. 7 is a perspective view of a portion of a warp yarn of non-circular cross section for incorporation into the weave structure of FIG. 1.

DETAILED DESCRIPTION OF THE DRAWINGS

Figures 1, 2:
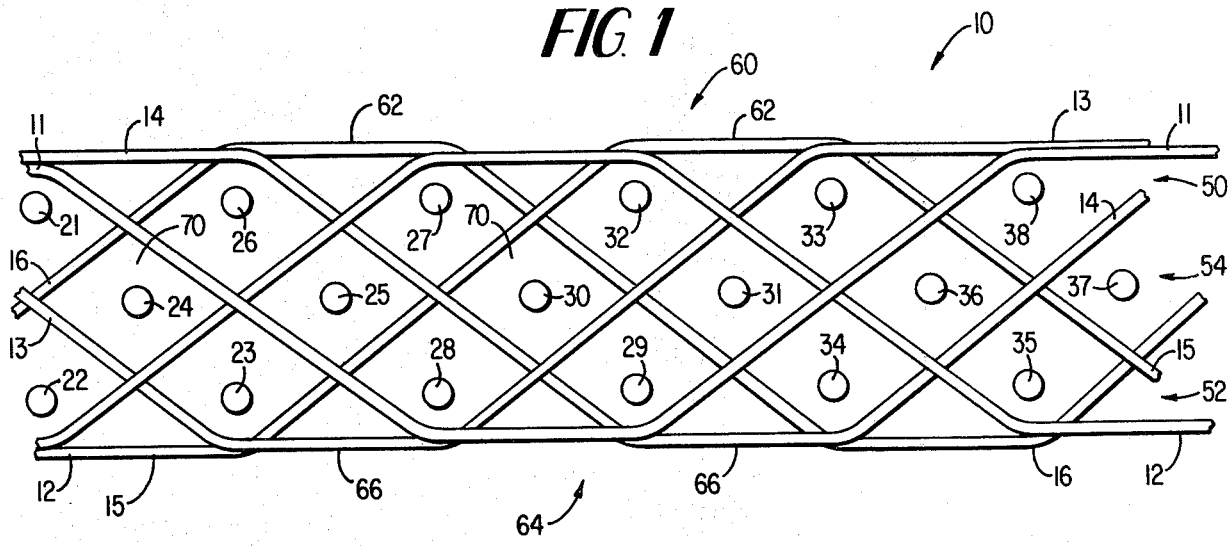
FIG. 1 is a section through the weft of a fabric embodying the teachings of the present invention.
FIG. 2 is a weave pattern for generating the fabric shown in FIG. 1.

With reference to FIGS. 1 and 2, a fabric, generally designated as 10, embodying the teaching of the subject invention, basically comprises a plurality of machine direction or warp yarns 11 through 16 interwoven with a plurality of cross-machine direction or weft yarns 21 through 38. As oriented in FIG. 1, weft yarns 21, 26, 27, 32, 33, and 38 define a top plane 50, weft yarns 22, 23, 28, 29, 34 and 35 define a bottom plane 52, and stuffer picks 24, 25, 30, 31, 36, and 37 define an intermediate plane 54 disposed between top plane 50 and bottom plane 52.

Warp yarns 11 through 16 are interwoven with weft yarns 21 through 28 in accordance with the weave pattern shown in FIG. 2, which is the technical design of a weave. A weave pattern is drawn on a squared paper, on which the vertical lines of squares represent warp yarns, while the horizontal lines represent weft yarns. A filled-in square indicates that the warp yarn it represents is above the weft, whereas a blank means weft above warp. Every pattern repeats itself. The area comprising the minimum number of warp and weft intersections constituting the pattern is called a "Weave repeat".

In weaving a fabric, warp yarns are raised and lowered in a predetermined sequence, determined by the weave pattern, so that they form a "shed" or passage for weft yarns. The formation of the passage is referred to in the art as "shedding". Inserting a weft yarn between the divided warp yarns is called "picking".

The weave pattern of FIG. 2 is read from right to left and from top to bottom. Thus, the weave pattern of FIG. 2 contains the following sequence of shedding and picking instructions:

shedding instruction No. 1—lower all warp yarns except the first and fourth, which are raised.
picking instruction No. 1—pick first weft yarn.
shedding instruction No. 2—raise all warp yarns except the second and fifth, which are lowered.
picking instruction No. 2—pick second weft yarn.

shedding instruction No. 3—raise all warp yarns except the third and fifth, which are lowered.
picking instruction No. 3—pick third weft yarn.
shedding instruction No. 4—lower all warp yarns except the first, fourth and sixth, which are raised.
picking instruction No. 4—pick fourth weft yarn.
shedding instruction No. 5—raise all warp yarns except the first, third and fifth, which are lowered.
picking instruction No. 5—pick fifth weft yarn.
shedding instruction No. 6—lower all warp yarns except the fourth and sixth, which are raised.
picking instruction No. 6—pick sixth weft yarn.
shedding instruction No. 7—lower all warp yarns except the second and sixth, which are raised.
picking instruction No. 7—pick seventh weft yarn.
shedding instruction No. 8—raise all warp yarns except the first and third, which are lowered.
picking instruction No. 8—pick eighth weft yarn.
shedding instruction No. 9—raise all warp yarns except the first and fourth, which are lowered.
picking instruction No. 9—pick nineth weft yarn.
shedding instruction No. 10—raise all warp yarns except for the first, third and fourth, which are lowered.
picking instruction No. 10—pick tenth weft yarn.
shedding instruction No. 11—lower all warp yarns except for the second, third and fifth, which are raised.
picking instruction No. 11—pick eleventh weft yarn.
shedding instruction No. 12—lower all warp yarns except for the second and fifth, which are raised.
picking instruction No. 12—pick twelfth weft yarn.
shedding instruction No. 13—lower all warp yarns except for the third and fifth, which are raised.
picking instruction No. 13—pick thirteenth weft yarn.
shedding instruction No. 14—lower all warp yarns except for the firth, second, third and fifth, which are raised.
picking instruction No. 14—pick fourteenth weft yarn.
shedding instruction No. 15—raise all warp yarns except for the second and sixth, which are lowered.
picking instruction No. 15—pick fifteenth weft yarn.
shedding instruction No. 16—lower all warp yarns except the first, third and fifth, which are raised.
picking instruction No. 16—pick sixteenth weft yarn.
shedding instruction No. 17—lower all warp yarns except the first, third and fourth, which are raised.
picking instruction No. 17—pick seventeenth weft yarn.
shedding instruction No. 18—lower all warp yarns except the first and third, which are raised.
picking instruction No. 18—pick eighteenth weft yarn.

It is to be understood that the sequence of shedding and picking instructions will yield a Weave repeat. When a fabric is woven, the Weave repeat is carried out over and over a sufficient number of times to yield a fabric of desired width and desired length.

Warp yarns 11 through 16, which are preferably of non-circular cross section, define a top or paper-contact surface 60 comprising a plurality of two-floats 62, and a bottom, non-paper side or machine roll contacting surface 64 comprising two-floats 66. As used herein, the term "float" means the portion of a warp or weft yarn that extends over one or more adjacent weft or warp ends in weaving. The float length of 2 for floats 62 and 66 is given in the context of a preferred embodiment. Other float lengths, for example 3 through 6, are also contemplated. In addition, the warp yarns 11 through 16 define a series of stuffer pick receiving sheds 70, each of which extends in the weft direction, transverse of the fabric length. The sheds are arranged one next to the other throughout the full length of the fabric and are disposed intermediate between the top and bottom planes 50 and 52. Each of the sheds 70 is a four sided structure with each side being defined by a different warp yarn. For example, with reference to FIG. 5, one such shed 70 is shown having four sides 71 through 74 with each side being formed by one of rectangular warp yarns 11, 12, 13 and 16. In this way, the walls of the sheds tend to be smoother than when warp yarns of circular cross section are employed. Each of the sheds 70 can receive a specific stuffer pick, for example, stuffer pick 24 for the shed shown in FIG. 5. It is contemplated that for some applications, some or all of the sheds may receive more than one stuffer pick. Under any circumstances, however, each stuffer pick extends longitudinally throughout the full length of the shed.

In the embodiment shown in the FIG. 1, the weft yarns, used to define the top and bottom planes 50 and 52, as well as the warp yarns 11 through 16 are typically synthetic yarns. In the same embodiment, these yarns are monofilament synthetic yarns made of polyester or nylon/polyester combinations in the warp (i.e., half the total ends are nylon and half are polyester) and polyester in the weft.

It is to be understood that other yarns of various constructions and materials may be used, for example, polypropylene and high temperature monofilaments such as P.F.A. However, it has been observed that by employing polyester monofilament type yarns, a fabric made thereof finds wide application for the drying of various types of paper with only the stuffer pick structure being changed in accordance with the permeability requirements of the type of paper being dried and the speed and particular section of the paper machine on which the fabric is to run.

In terms of configuration, the weft yarns are of circular cross section, whereas the warp yarns are of rectangular cross section. With reference to FIG. 7, a portion of a rectangular warp yarn is shown. Typically, the height H, as measured along axis b, of the yarn is 0.38 mm, whereas the width W, as measured along axis a, is 0.63 mm thus providing a height to width ratio of 1:1.66. As shown in FIG. 7, the long axis, axis a, is generally parallel to the plane defined by the fabric, whereas the short axis, axis b, is generally perpendicular to axis a.

In terms of general inclusion of the rectangular warp yarns in a papermakers fabric, it has been observed that, because fibrillation takes place in rectangular yarns having a ratio greater than 1:2, such greater ratios should be avoided and ratios in the range of 1:1 to 1:1.7 yield the best results.

It is to be understood that additional cross sectional shapes for the warp yarns are contemplated. For example, the warp yarn may have an elliptical cross section, again, with the long axis being generally parallel to the plane defined by the fabric. As yet another example, the warp yarn may have a "D" cross section with the flat surface of the "D" being generally parallel with the plane defined by the fabric.

In its position of intended use within the fabric 10, the rectangular warp yarn has a top surface 92, a bottom surface 94, and two side surfaces 96 and 98. The top and bottom surfaces, which are of greater dimension than the side surfaces, typically are in contact with the weft yarns 21 through 28. In addition, depending on the endage count for the rectangular warp yarns, the spacing between the side surfaces of adjacent warp yarns may be varied thus giving rise to a convenient way to control permeability.

It has been observed that the endage count cannot be too high, because such as condition will cause the warp direction floats to twist over each other. It has likewise been observed that the endage count cannot be too low, because of the undesirable decrease in contact area associated with such a condition.

The long warp floats 62, which define the paper side 60 of the fabric 10, present a fabric surface which has a considerably greater paper-contacting area than that found in the conventional duplex fabrics previously described. This increase in contact area may be attributed to both the use of rectangular warp yarns and the float distribution created by the weave pattern. It has been observed that the increase in contact area provides better support for and guiding of the paper web in its passage through the dryer section of a papermaking machine. Heat transfer also is greatly improved, thus increasing paper drying efficiency. Finally, the increase in contact area better controls paper sheet width shrinkage and also produces a more even moisture profile throughout the paper sheet.

In addition, the employment of floats 62 throughout the surface 60 of the fabric 10 presents a very smooth surface to the paper sheet giving excellent non-marking characteristics, thus, providing the fabric with the potential to operate on all grades of paper. This is to be contrasted against the conventional duplex fabric which, because of its sharper knuckles, results in a lower sheet contact area. The sharper knuckles also prevent the usage of the duplex fabric on certain super critical grades of paper, namely those where sheet smoothness and non-marking is of critical importance.

The long warp floats 66, which define the non-paper surface 64 of the fabric, present a high contact surface area to the machine rolls, such as, guide rolls. This increase in contact area is attributed to the same factors as warp floats 62, which define the paper side 60 of the fabric 10.

It has been observed that increasing the contact area provided between the roll contacting surface 64 and the guide roll results in improved guide control by the guide rolls of the papermaking machine. This substantially reduces the likelihood of the fabric running into the machine frame and thus reduces the likelihood of damage to the lateral edges of the dryer fabric. This attribute of a fabric produced according to the subject invention is of particular importance on older papermaking machines where the angle of wrap of the fabric on the guide roll is less than the standard 30°.

Another advantage of the long floats 66 on the non-paper surface 64 of the fabric is the improved abrasion resistance due to the elimination of sharp angled warp knuckles, such as those found in the standard duplex weave. Abrasive sources, such as rusty or pitted pocket rolls (the rolls located between cylinder dryers), frequently create wearing problems on the non-paper contacting surface of the fabric. This problem of rusty or pitted rolls is increasing because of the employment of synthetic yarns to define present day dryer fabrics. The synthetic yarns do not readily absorb moisture, and, therefore, there is more free moisture in and around the papermaking machine. This, coupled with the reduction or elimination of felt drying equipment, further increases rusting and pitting of exposed rolls.

A fabric such as that shown in FIG. 1, through the provision of numerous stuffer pick receiving sheds 70, permits the use of various styles of stuffer picks, such as those made from spun, multifilament, monofilament, glass or combinations thereof to produce a series of dryer fabrics with a wide range of permeability values. Examples of stuffer picks which yield superior results in the context of a fabric, such as that shown in FIG. 1, are those made from 2 ends of 2's cotton count spun acrylic or spun polyester fibers twisted together; 6, 8, 10 and 12 fine monofilaments twisted together; heavy glass (15/1/10) core wrapped with multifilament synthetic yarns (nylon and/or polyester) and phenolic resin treated; and heavy glass (15/1/0) core wrapped with spun acrylic and spun polyester fiber and phenolic resin treated. Also, meltable stuffer picks, such as those described in detail in copending U.S. patent application Ser. No. 258,046, "Papermakers Fabric Using Differential Melt Yarns", filed even date herewith in the name of William T. Westhead, may be used.

Permeability control is very important because each dryer section in a papermaking machine requires that the fabric be at optimum permeability values for each particular section in the machine. For purposes of the present application, permeability is the amount of air passing through a papermakers belt under given conditions. Permeability is usually expressed in cubic feet of air per minute passing through one square foot of fabric at 0.5 inch water gauge pressure.

In a fabric according to the subject invention, it is desirable to provide pin seams at the warp ends. FIGS. 3 and 4 schematically illustrate the formation of a binder loop 80 and a seam loop 80' for two of the warp yarns 11 and 15, respectively.

The fabric shown in FIGS. 1 and 6 is typically woven to a weft yarn density of approximately 30 to 70 yarns per inch and a warp yarn density of approximately 40 to 100 yarns per inch, with approximately 45 to 65 yarns per inch being preferred. After weaving and heat stabilization have been completed, the fabric is removed from the machine, and, at each of the fabric ends to be seamed approximately six inches of weft yarns are manually removed. This leaves a fringe made up of six-inch warp yarns along each end of the fabric. Each of the warp yarns is then woven back into the fabric, with a select number of the warp yarns being woven back in, less one crimp length, thus yielding a seam loop. As used herein, the term "crimp length" means the length of the warp yarn during one complete cycle of the weave pattern. In the embodiment shown in FIG. 1 and using warp yarn 11 as an example, the crimp length for warp yarn 11 is the distance from weft yarn 21 to weft yarn 38 when the warp yarn is removed from the weave and stretched to a taut condition. In the embodiment shown in FIGS. 1 and 6, one warp yarn in every six defines a deam loop with the remaining warp yarns being fully rewoven into the fabric. However, other spacings for the seam loops will readily suggest themselves to those skilled in the art.

With reference to FIG. 3, the formation of binder loop 80 through the use of warp yarn 11 is shown. It is to be understood that FIG. 3 is a schematic diagram of the important aspects of binder loop formation and does not show this formation to scale. Prior to being rewoven into its position as shown in FIG. 3, warp yarn 11 along with warp yarns 12–16 defines a fringe at the warp end 86 of the fabric 10. Subsequent to weaving and before removal of the weft yarns, the fabric 10 was heat stabilized so that the warp yarns assumed a relatively permanent configuration within the fabric. For warp yarn 11 this is of the general configuration shown in FIG. 1. When the weft yarns are removed to define the fringe, warp yarn 11 retains this configuration within the fringe. The yarn is then turned back upon itself to define the binder loop 80, which keeps weft yarns 35 and 38 in place. Warp yarn 11, having been turned back upon itself, is then manually rewoven into the fabric. As is evident from FIG. 3, the warp yarn 11 is rewoven into the fabric in such a manner that it produces a mirror image of itself when viewed with respect to the plane 82 defined by the stuffer picks 24, 25, 30, 31, 36 and 37. Thus it can be seen that the present invention provides for a symmetrical binder loop with symmetrical reweaving.

FIG. 4, in a manner similar to FIG. 3, schematically illustrates the formation of a seam loop 80′ using warp yarn 15. The loop 80′ of FIG. 4 differs from the loop 80 of FIG. 3 in that loop 80′ is formed by a warp yarn which is offset by one crimp length, that crimp length forming the seam loop 80′ which will ultimately be joined by a cable to similarly formed loops on the other end of the fabric to make the fabric endless on the paper machine.

From the loop formed in FIG. 4, it can be seen that, because of a symmetrical construction, these loops remain within the plane 82 of the fabric and are not shifted out of this plane, as would occur in a fabric which does not provide for the symmetrical reweaving. Also, because of the crimp length, the resultant loop 80′ is of much greater size than would be found by creating seam loops in the known papermakers belts. The larger symmetrical seam loop 80′ allows the pin seams 88 to be joined together with a seam cable (not shown) in one operation.

By employing the rectangular warp yarns to create the binder and seam loops, eventual joining of the pin seams at the warp ends of the fabric is made easier. As oriented in FIGS. 3 and 4, the seam loops 80′ formed by the rectangular warp yarns are more rigid and have a wider dimension in the general plane of the fabric 10, than is found when employing warp yarns of circular cross section. Because of the rigidity and favorable dimensional characteristics exhibited by the rectangular warp yarns, the seam loops intermesh and mate much easier during the manual joining of fabric ends than exists with prior fabrics.

In forming the fabric ends, it is possible that a "ridging" effect could occur in which certain cross-machine direction yarns shift up and down to create undulations in the machine direction or warp yarns. Such a condition takes place only at the seam end. To prevent this condition and to further improve the smoothness of the surfaces associated with the fabric ends, the order in which the warp yarns are marked and drawn into the loom is changed. In addition, the order in which the picks or cross-machine direction yarns are inserted also is changed.

Figures 8, 9:
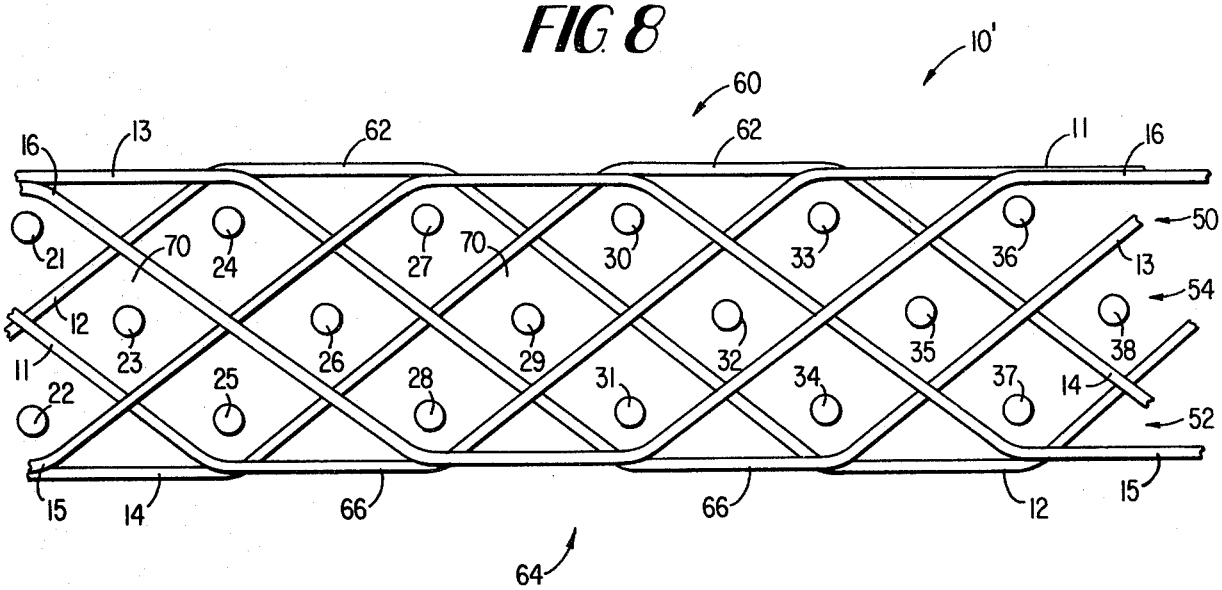
FIG. 8 is a section through the weft of a second fabric embodying the teachings of the present invention.
FIG. 9 is a weave pattern for generating the fabric shown in FIG. 8.

FIGS. 8 and 9 illustrate an embodiment of a fabric 10′ in which the "ridging" effect has been eliminated. As is readily apparent, neither the appearance nor the characteristics of the fabric 10′ have been changed from those noted with regard to fabric 10 of FIGS. 1 and 2. As noted before, the only changes between the fabric of FIG. 1 and the fabric of FIG. 8 relates to the drawing of the warp yarns and the picking of the weft yarns. These changes are noted in the drawings where like numerals denote like elements. Basically, the warp yarns 11–16, instead of being straight drawn, as shown in FIG. 1, are drawn into the loom so that, in effect, warp yarns 11, 12, 13, 14, 15, 16 of FIG. 1 become warp yarns 16, 15, 11, 13, 14, 12, respectively, of FIG. 8. Further, instead of weaving the weft yarns 21–38 in the order top-bottom-bottom-center-center-top, as shown in FIG. 1, the weft yarns are woven in the order top-bottom-middle, as shown in FIG. 8.

Although the present invention has been described primarily in the context of a dryer fabric, it is contemplated that other fabrics, such as forming fabrics and press felts, may be improved by incorporating the teachings of the subject invention.

A forming fabric produced according to the weave pattern of FIGS. 1 and 2 exhibits more uniform drainage because of the symmetrical weave. The smooth paper-side surface 60 gives good sheet formation and sheet release as the paper leaves the forming fabric and moves onto the press section of the papermaking machine. The non-paper side 64 of the forming fabric gives increased abrasion resistance against stationary objects in the forming fabric run. Further, the use of the long warp floats 62 and 66 reduces the number of warp/weft locking points, and, therefore, the forming fabric will run cleaner. This is also true of dryer fabrics.

Forming fabrics do not generally have a seam. Normally they are woven as a flat fabric, the ends then being fringed as for a loop seam. However, the warp ends from both ends of the fabric are then hand woven back through a set of weft picks to give an endless seam.

With regard to press felts, these felts are generally produced by needling a batt of fibers onto a base fabric to make something like a blanket. Such a batt of fibers 94 is illustrated in FIG. 6 in phantom. The weave design of FIGS. 1 and 2 is advantageous as a base fabric, primarily because the symmetrical weave provides uniform drainage through the base fabric. By providing a smooth even surface 60 on the top of the fabric 10, the press felt manufacturer is able to produce a smooth even batt surface thus reducing or eliminating press roll bounce and bumping. As in the case of forming fabrics, press felts are generally endless and the base fabric is generally either woven endless or is seamed endless prior to needling of the batt.

Although the present invention has been shown and described in terms of a specific preferred embodiment, it will be appreciated by those skilled in the art that changes and modifications are possible which do not depart from the inventive concepts described and taught herein. Such changes and modifications are deemed to fall within the purview of these inventive concepts.

What is claimed is:

1. A papermakers fabric comprising:

a first layer defined by a first plurality of weft yarns;

a second layer defined by a second plurality of weft yarns;

a plurality of stuffer picks; and a plurality of warp yarns of non-circular cross section interwoven with said weft yarns to define a first surface on said first layer, a second surface on said second layer, and a plurality of stuffer pick receiving sheds interposed between said first and second layers, each shed for receiving at least one of said stuffer picks, a select number of said shed defining warp yarns extending out of a warp end of said fabric and being symmetrically rewoven into said fabric to produce a mirror image of itself when viewed with respect to the plane defined by said stuffer picks and to define a number of seam loops, one seam loop being formed by at least one of a preselected number of adjacent shed defining warp yarns.

2. The papermakers fabric of claim 1, wherein each of said stuffer pick receiving sheds has four sides, each side being defined by one of said warp yarns of non-circular cross section.

3. The papermakers fabric of claim 1, wherein the size of each of said seam loops is determined by one crimp length of said warp yarn.

4. The papermakers fabric of claim 1, wherein said weft yarns are monofilament yarns.

5. The papermakers fabric of claim 1, wherein said warp yarns are monofilament yarns having a generally rectangular cross section.

6. The papermakers fabric of claim 1, wherein said stuffer picks are selected from the group consisting of monofilament yarns, multifilament yarns, staple yarns, and spun yarns.

7. The papermakers fabric of claim 1 wherein each of said seam loops is positioned symmetrically relative to said first and said second surfaces.

8. The papermakers fabric of claim 7 wherein each of said warp yarns is symmetrically rewoven into said fabric.

9. A papermakers fabric comprising:

a first layer defined by a first plurality of cross-machine direction weft yarns of circular cross section;

a second layer defined by a second plurality of cross-machine direction weft yarns of circular cross section; and a plurality of machine direction warp yarns of generally rectangular cross section, each of said warp yarns interwoven with each of said layers of weft yarns to define a first surface of flat warp direction floats on said first layer and a second surface of flat warp direction floats on said second layer, said floats in each of said first and second surfaces spanning at least two weft yarns, wherein all said warp yarns extend out of a warp end of said fabric and are symmetrically rewoven into said fabric to produce a mirror image of itself when viewed with respect to an intermediate plane of said fabric and to define a number of binder loops and a number of seam loops, one seam loop being formed by at least one of a preselected number of adjacent warp yarns.

10. The papermakers fabric of claim 9, wherein all of the floats of said first surface are of equal length.

11. The papermakers fabric according to claim 10, wherein all of the floats of said second surface are of the same length.

12. The papermakers fabric according to claim 11, wherein all of the floats of said first and second surfaces are of the same length.

13. A papermakers fabric comprising:

a first layer defined by a first plurality of weft yarns;

a second layer defined by a second plurality of weft yarns; and a plurality of warp yarns of non-circular cross section interwoven with said weft yarns to define a first surface on said first layer, a second surface on said second layer, and a plurality of stuffer pick receiving sheds interposed between said first and second layers, said warp yarns extending out of a warp end of said fabric, and being symmetrically rewoven into said fabric to produce a mirror image of itself when viewed with respect to the plane defined by said stuffer picks and to define a number of seam loops, one seam loop being formed by at least one warp yarn in every six adjacent warp yarns, the remaining warp yarns defining binder loops.

* * * * *